US008320811B2

(12) United States Patent
Kagawa

(10) Patent No.: US 8,320,811 B2
(45) Date of Patent: Nov. 27, 2012

(54) IMAGE RECORDING MEDIUM, IMAGE RECORDING MEDIUM REUSING APPARATUS, IMAGE FORMING APPARATUS USING THE SAME AND IMAGE RECORDING MEDIUM REUSING METHOD

(75) Inventor: Toshiaki Kagawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 307 days.

(21) Appl. No.: 12/721,687

(22) Filed: Mar. 11, 2010

(65) Prior Publication Data

US 2010/0254738 A1 Oct. 7, 2010

(30) Foreign Application Priority Data

Apr. 1, 2009 (JP) ..... 2009-089401

(51) Int. Cl.
*G03G 15/041* (2006.01)

(52) U.S. Cl. ..... 399/341; 503/200

(58) Field of Classification Search ..... 399/107, 399/122, 320, 335–338, 341; 500/200, 202, 500/218

See application file for complete search history.

(56) References Cited

U.S. PATENT DOCUMENTS 7,560,415 B2 * 7/2009 Tsuboi et al. ..... 503/200
2008/0317487 A1 12/2008 Murakami

FOREIGN PATENT DOCUMENTS

| | | |
|---|---|---|
| EP | 0 693 386 A1 | 1/1996 |
| JP | 07-239643 | 9/1995 |
| JP | 08-050431 | 2/1996 |
| JP | 11-231739 | 8/1999 |
| JP | 2007-199594 A | 8/2007 |

* cited by examiner

*Primary Examiner* — Hoan Tran
(74) *Attorney, Agent, or Firm* — Renner, Otto, Boisselle & Sklar, LLP

(57) ABSTRACT

An image recording medium that can be repeatedly used by removing the toner image has a three-layered structure formed of a heat-resistant resin sheet and a pair of releasing and light absorptive layers coated on both sides of the heat-resistant resin sheet. The releasing and light absorptive layer generates heat by absorbing laser so as to fuse and fix the toner image formed on the special sheet surface at the time of image forming, and assures pertinent releasing performance at the time of image removal so as to facilitate removal of the re-fused toner image. Each releasing and light absorptive layer may be split into a light absorptive layer and a releasing layer. The heat-resistant resin sheet may be produced by adding an infrared absorbent to a heat-resistant resin sheet to serve as a heat-resistant sheet and a light absorptive layer.

24 Claims, 8 Drawing Sheets

IMAGE RECORDING MEDIUM, IMAGE RECORDING MEDIUM REUSING APPARATUS, IMAGE FORMING APPARATUS USING THE SAME AND IMAGE RECORDING MEDIUM REUSING METHOD

This Nonprovisional application claims priority under 35 U.S.C. §119 (a) on Patent Application No. 2009-089401 filed in Japan on 1 Apr. 2009, the entire contents of which are hereby incorporated by reference.

BACKGROUND OF THE INVENTION (1) Field of the Invention

The present invention relates to an image recording medium which is used in an electrophotographic process using a laser for toner fixing toner and toner removing and enables reuse of the image recording medium, an image recording medium reusing apparatus, an image forming apparatus including the same, and an image recoding medium reusing method.

(2) Description of the Prior Art

Lately, global environmental issues, in particular, the global warming problem resulting from emission of greenhouse gases, has caused a notably serious situation. In the field of image forming apparatuses such as copiers, printers etc., which use electrophotography, when the load on the environment of a product in the whole course of its life was evaluated by $CO_2$ emission equivalent in Life Cycle Assessment (LCA), it turned out that the amount of $CO_2$ arising in manufacturing image recording mediums (paper) that are consumed by the image forming apparatus is predominantly greater than the amount of $CO_2$ generated at the time of manufacturing or disposal of the apparatus itself or the amount of $CO_2$ corresponding to the electric power that is consumed by the apparatus itself. Accordingly, in order to sharply reduce the load on the environment from an image forming apparatus, reuse of paper is most effective.

From this viewpoint, various kinds of technologies for reusing sheets of paper that have been once image formed have been proposed.

Patent document 1 (Japanese Patent Application Laid-open H09-197926) discloses a technology of reusing the paper by separating the toner image from the paper by means of a heated separating member.

Patent document 2 (Japanese Patent Application Laid-open 2006-154485) discloses a technology of reusing the paper by erasing the shade of the toner image that has been formed using a toner that disappears when heated.

Patent document 3 (Japanese Patent Application Laid-open H01-101577) discloses a technology of reusing OHP film by removing the toner image from the film surface by immersing the toner on the OHP film in a toner resin-soluble solvent for a predetermined period to remove the toner image from the film surface.

Patent document 4 (Japanese Patent Application Laid-open H09-179461) discloses a technology of reusing the paper by applying a thermally fusible material to the toner image, heating and fusing the material with the tone image, pressing a releasing medium against the molten material and then parting the releasing medium from the paper to transfer the toner image with the thermally fusible material.

However, the above conventional reusing technologies suffer from the problems as follows.

That is, in the reusing technology described in patent document 1, a large amount of heat energy is needed when the toner is separated from the paper, hence this method is by no means preferable when the load on the environment is totally estimated. Further, the paper is thermally and mechanically damaged when the toner image is separated from the paper, hence this method also has the problem that the number of times of reusing is limited to several times.

In the reusing technology described in patent document 2, even if the shade of the toner image has been disappeared the toner resin still remains on the paper, so that it is impossible to make the image completely invisible. As a result, not only the number of times of reusing is limited but it is also undesirable in view of security. Further, since thermal energy is needed to erase the shade of the toner, this method is by no means preferable when the load on the environment is totally evaluated.

The reusing technology described in patent document 3 is aimed at OHP film. That is, the utility is limited. Further, since the toner resin may be made of polyester which is the same resin for forming OHP film, if this technology is used to deal with the toner resin of polyester, there occurs the problem that the film itself is also dissolved in the soluble solvent. Further, when the toner resin and OHP film are made of polyester resin, the toner presents a high affinity for OHP film. As a result, the fixing strength of the toner after fusing and fixing becomes very high, so that it is difficult to readily remove the toner image with the soluble solvent. In addition, the hydrophilic of the OHP film surface is high (the contact angle of polyester resin with water is 78°), and the soluble solvent that is based on water is ready to wet the film surface, so that there is also the problem that the solvent is consumed too much.

Further, the reusing technology described in patent document 4 has the problem that the thermally fusing material is consumed when erasing the image. Though the thermally fusing material does not contain any coloring agent like the conventional toner, it is also formed of toner material. Toner material in itself is expensive compared to the paper and produces $CO_2$ when the toner is manufactured, hence it does not lead to reduction in environmental load. Further, this method needs separate heat sources for image recording and image erasing, resulting in a complicated configuration. Also, since the heat roller and the separating and heating roller have high heat capacities, it takes time to warm up the reusing apparatus. That is, it is necessary to always heat the apparatus beforehand for convenient handling, hence waste standby electricity is needed.

SUMMARY OF THE INVENTION

It is therefore an object of the present invention to provide a reusable and easy-to-use image recording medium, a reusing method of the recording medium and a reusing apparatus with a simple compact structure as well as to provide an image forming apparatus including the reusing apparatus, without requiring waste consumables and standby electricity.

The first aspect of the present invention resides in an image recording medium that can be used repeatedly by erasing toner images, comprising a light absorptive layer that absorbs light to generate heat, provided in the vicinity of the surface thereof.

With this configuration, since a light absorptive layer that absorbs light and converts it into heat is provided on the surface of image recording medium, it is possible to solve the problem that, when laser, flush or other light is used as a fixing device for a reusable image recording medium, it is difficult to absorb light and hence fix toner as a result of the color toners or the toner of halftoned image patterns, and hence it is possible to assure uniform fixing performance without depending on the kind (color) of the toner and image pattern (density).

The second aspect of the present invention is characterized in that the light absorptive layer includes a fluororesin.

Since the fluororesin is excellent in releasability for toner, this configuration makes it possible to readily remove toner from the image recording medium.

The third aspect of the present invention is characterized in that the surface of the light absorptive layer is additionally coated by a transparent releasing layer.

The fourth aspect of the present invention is characterized in that the releasing layer is formed of a fluororesin.

In accordance with these configurations, provision of a transparent releasing layer will not shade light, hence makes it possible to heat the light absorptive layer with light. Further, since the function of the releasing layer and that of the light absorptive layer are split, it is possible to specialize the releasing layer for releasing purposes and the light absorptive layer for heat generation purposes, hence maximize the individual effects. As a transparent releasing layer, fluororesin is preferable.

The fifth aspect of the present invention is characterized in that the image recording medium further includes a substrate formed of a heat-resistant resin.

The sixth aspect of the present invention is characterized in that the heat-resistant resin is an allylester curing resin.

In accordance with these configurations, since the substrate is formed of a heat-resistant resin, the substrate will not melt even if laser or other kinds of light is irradiated, hence making it possible to fuse and fix the toner image only. In particular, allylester curing resin has a heat-resistant temperature of 250 (° C.) or higher, hence can stand laser irradiation without any stress.

The seventh aspect of the present invention is characterized in that the substrate also serves as a light absorptive layer.

Since the substrate also serves as the light absorptive layer, it is possible to simplify the configuration of the image recording medium and realize low cost due to reduction of the manufacturing process.

The eighth aspect of the present invention resides in an image recording medium reusing apparatus, comprising: a conveyor for conveying an image recording medium with a toner image formed thereon; a laser emitter for emitting laser to the image recording medium; a removing portion whose surface is heated by the laser emitter for removing the toner image from the image recording medium by thermally fusing the toner image by abutting the heated surface against the toner image surface of the image recording medium; and, a controller for controlling the conveyor, the laser emitter, and the removing portion, and is characterized in that the laser emitter also serves as a fixing heat source for fixing a toner image to an image recording medium, and a light absorptive layer that absorbs light to generate heat is provided in the vicinity of the surface of the image recording medium. According to the ninth aspect of the present invention, the toner image is formed of a color toner.

In this configuration, since a light absorptive layer that absorbs laser light and converts it into heat is provided on the surface of image recording medium, it is possible to solve the problem that, when the laser emitter is used as a fixing heat source, it is difficult to absorb light and hence fix toner as a result of the color toners or the toner of halftoned image patterns, and hence it is possible to assure uniform fixing performance without depending on the kind (color) of the toner and image pattern (density).

The tenth aspect of the present invention is characterized in that the image recording medium reusing apparatus further includes: an optical path changer for changing the optical path of the laser light emitted from the laser emitter, and that the laser light is led to irradiate the removing portion by means of the optical path changer so that the removing portion generates heat, and a toner image on an image recording medium consisting of plain paper is fixed with heat and pressure from the removing portion by bringing the removing portion in abutment with the toner image surface of the image recording medium.

Accordingly, it is possible to easily make common usage of image recording apparatus and recording medium reusing apparatus, and also fixing can be performed on the image recording medium not only for a special sheet coated with a light absorptive layer but also for a plain paper.

The eleventh aspect of the present invention is characterized in that the surface of the removing portion is formed of a fluororubber.

Since fluororubber is ready to absorb laser light and is low in releasability compared to the fluororesin of the surface of the image recording medium, it is possible to readily remove the toner image.

The twelfth aspect of the present invention is characterized in that the image recording medium reusing apparatus further includes an applicator for applying an amino-modified silicone oil to the surface of the removing portion.

When the surface of the removing portion is formed of fluororubber, the surface is lower in releasability for the toner. As a result, if the toner is tried to be fixed to plain paper as in the tenth configuration, the toner will set off to the removing portion. To avoid this, application of amino-modified silicone oil, which has a high affinity for fluororubber, over the fluororubber surface makes it possible to prevent offset.

The thirteenth aspect of the present invention is characterized in that the applicator also serves as a cleaning portion of the toner collected by the removing portion.

Accordingly, since no separate applicator needs to be provided, it is possible to make the reusing apparatus compact and inexpensive.

The fourteenth aspect of the present invention is characterized in that the controller changes the conveying speed of the image recording medium between when a toner image is fixed in an image forming mode and when a toner image is removed in an image erasing mode.

The fifteenth aspect of the present invention is characterized in that the controller sets the conveying speed of the image recording medium in the image erasing mode lower than the conveying speed in the image forming mode.

The sixteenth aspect of the present invention is characterized in that the controller changes the output power of the laser emitter between when a toner image is fixed in an image forming mode and when a toner image is removed in an image erasing mode.

The seventeenth aspect of the present invention is characterized in that the controller sets the output power of the laser emitter in the image erasing mode higher than the output power in the image forming mode.

There occur cases where the necessary amounts of thermal energy become different between the image forming mode (for toner image fixing) and the image erasing mode (for toner image removal). In particular, since the laser light is radiated directly to the toner image in the image forming mode whereas the laser light is used in an indirect manner (the laser light is reflected by a reflecting mirror first, then absorbed by the removing portion) in the image erasing mode, the laser efficiency lowers in the image erasing mode. To deal with this, the paper conveying speed may be retarded or the laser power may be enhanced in the image erasing mode so as to secure the necessary amount of energy.

The eighteenth aspect of the present invention is characterized in that the controller controls the laser light so as to selectively irradiate in accordance with image information.

In this configuration, the laser light is radiated on the areas where toner patterns are formed, in accordance with the image information, so that it is possible to reduce self-heating of the laser emitter to the bare minimum, hence improve heat efficiency.

The nineteenth aspect of the present invention is characterized in that the controller, based on the temperature information on the conveyor, controls the laser power or the sheet conveying speed.

Accordingly, when the laser power and the sheet conveying speed are controlled by detecting the temperature of the conveyor (conveyor belt) and feeding back the temperature information, it is possible to perform an optimal image forming (toner fixing) operation.

The twentieth aspect of the present invention is characterized in that the controller, based on the temperature information on the removing portion, controls the laser power or the sheet conveying speed.

Accordingly, when the laser power and the sheet conveying speed are controlled by detecting the temperature of the removing portion (toner removing roller) and feeding back the temperature information, it is possible to perform an optimal image erasing (toner removing) operation.

The twenty-first aspect of the present invention is characterized in that the laser emitter comprises a laser array formed of a plurality of semiconductor laser chips being arrayed in the direction perpendicular to the conveying direction of image recording mediums.

If a laser emitter of a single light source is applied particularly to a high-speed image forming apparatus, not only an expensive high-power laser device (e.g., $CO_2$ laser, YAG laser, or the like) is needed, but the apparatus also becomes bulky and complicated. Besides, it is difficult to radiate laser light on the toner image with precision. In contrast, in accordance with the present configuration, the cost for the semiconductor laser device is incomparably low, hence even if a plurality of laser chips are used to form a laser array, it is possible to realize a low-cost configuration compared to use of a laser emitter of a single light source. Further, since it is not necessary to condense laser light, the optical system can be disused, hence it is possible to cut off energy loss at the optical system. Also, it is possible to attach a large heat sink, hence improve cooling performance of the laser device.

The twenty-second aspect of the present invention resides in an image forming apparatus for electrophotographically forming an image with toner, comprising: an image bearer having an electrostatic latent image formed on the surface thereof; a charging device for electrifying the surface of the image bearer; a light exposure device for forming an electrostatic latent image on the image bearer surface; a developing device for forming a toner image by supplying the electrostatic latent image with toner; a transfer device for transferring the toner image to an image recording medium; a fixing device for fixing the transferred toner image to the image recording medium; and, an image recording medium reusing apparatus described in any of the eighth to twenty-first aspects.

The twenty-third aspect of the present invention is characterized in that, in image forming, part of the removing portion that is not receiving radiation of laser is abutted on the toner image surface of the image recording medium.

When a non-contact fixing technique such as laser fixing or the like is used, there occurs insufficiency of glossiness (the image is too matte) because the toner image after fixing will not be smoothened. To deal with this problem, it is possible to smoothen the toner image surface and enhance glossiness by abutting the removing portion on the toner image directly after fixing in the image forming mode.

The twenty-fourth aspect of the present invention is characterized in that the image forming apparatus further includes a duplex printing function, and that, in the duplex printing mode, image erasure is performed for the first page of the image recording medium, then image forming is performed for the second page of the image recording medium.

With this configuration, it is possible to perform image erasing and image forming at the same time just performing a single pass of paper.

The twenty-fifth aspect of the present invention resides in a medium reusing method of a recording medium that has been formed with an unfixed or fixed toner image, comprising the steps of:

in an image forming mode in which an unfixed toner image is fixed to an image recording medium, fixing an unfixed toner image to the image recording medium by directly radiating laser light on the image recording medium so as to heat the surface of the image recording medium, thereby heat and fuse the unfixed toner image; and, in an erasing mode in which a fixed toner image is removed from an image recording medium, removing the toner image from the image recording medium by radiating laser light on a removing portion so as to heat the surface of the removing portion and bringing the heated surface of the removing portion into contact with the toner image fixed on the image recording medium to thereby heat and fuse the toner image.

According to the present invention, provision of a light absorptive layer that absorbs light and converts it into heat on the surface of image recording medium, makes it possible to assure uniform fixing performance without depending on the kind (color) of the toner and image pattern (density). It is also possible to readily remove toner from the image recording medium.

DESCRIPTION OF THE PREFERRED EMBODIMENTS

One embodiment mode of the present invention will be described with reference to FIGS. 1 to 7. Though the present embodiment will be described by taking a case where the image forming apparatus of the present invention is applied to a color multifunctional machine, the present invention should not be limited to this and can be applied to a monochrome multifunctional machine.

Figure 1:
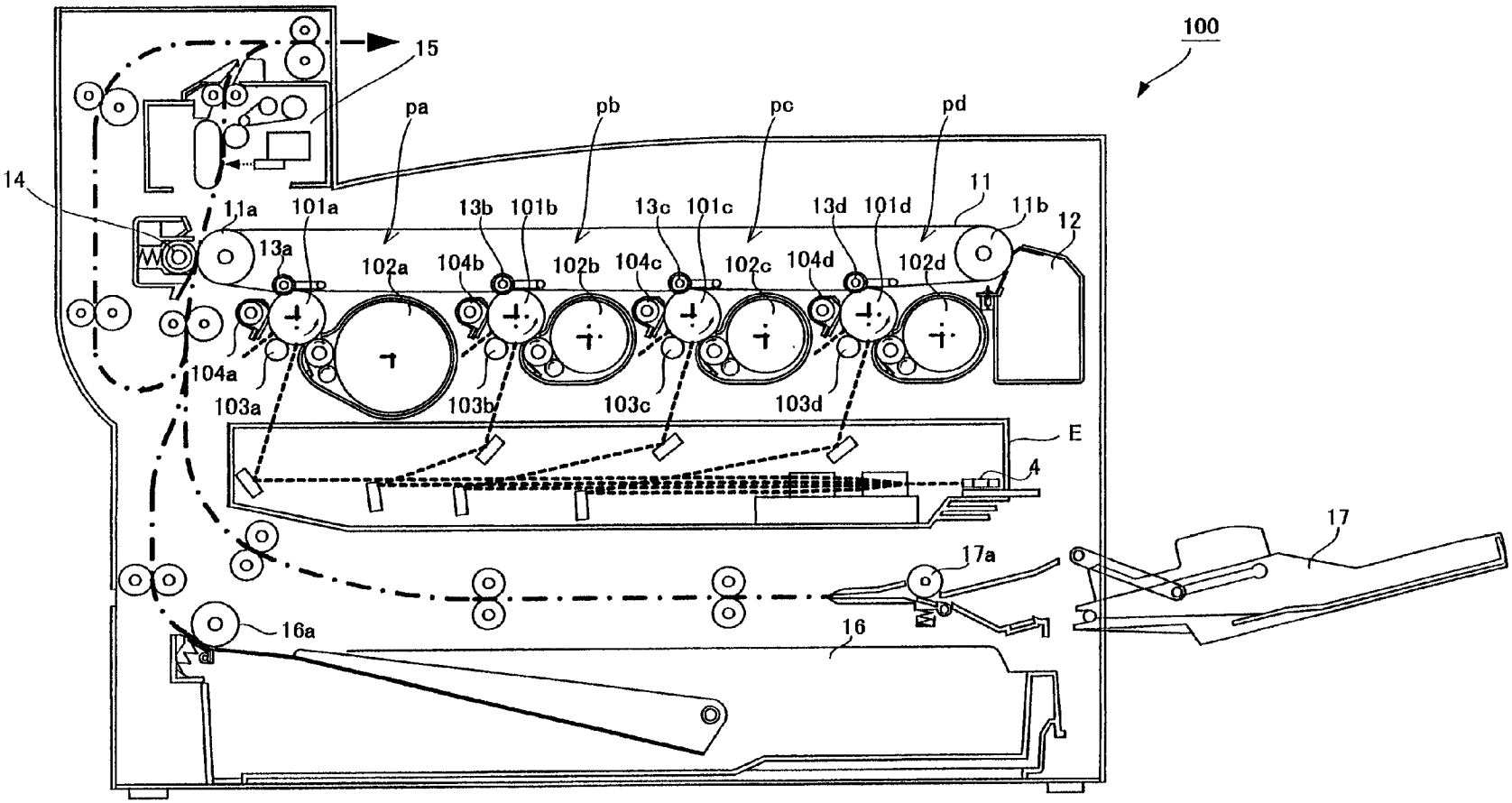
FIG. 1 is a diagram showing a schematic configuration of a color multifunctional machine.

As shown in FIG. 1, a color multifunctional machine 100 includes an optical system unit E, four sets of visual image forming units pa, pb, pc and pd, an intermediate transfer belt 11, a secondary transfer unit 14, a fixing and reusing unit 15, an internal paper feed unit 16 and a manual paper feed unit 17.

Visual image forming unit pa includes a photoreceptor 101*a* as a toner image bearer, and a charging unit 103*a*, a developing unit 102*a* and a cleaning unit 104*a* arranged around the photoreceptor. A primary transfer unit 13*a* is arranged at a position opposing photoreceptor 101*a* with intermediate transfer belt 11 in-between. The other three sets of visual image forming units pb, pc and pd have the same configuration as that of visual image forming unit pa. The developing units of visual image forming units (pd, pc, pb and pa) hold toners of respective colors, yellow (Y), magenta (M), cyan (C) and black (B).

Optical system unit E is arranged so that data from a light source 4 is conveyed to four photoreceptors 101*a*, 101*b*, 101*c* and 101*d*.

Intermediate transfer belt 11 is arranged without slack between tension rollers 11*a* and lib. A waste toner box 12 and a secondary transfer unit 14 are arranged and abutted against intermediate transfer belt 11 on the tension roller lib side and on the tension roller 11*a* side, respectively. Fixing and reusing unit 15 is disposed downstream of secondary transfer unit 14 with respect to the recording paper's direction of conveyance.

The process of image forming for the recording paper (image recording medium) is as follows:—

The photoreceptor 101*a* surface is uniformly electrified by charger unit 103*a*, the photoreceptor drum 101*a* is then irradiated with a laser in accordance with image information by optical system unit E to form an electrostatic latent image. As charging unit 103*a*, a charging roller type is adopted in order to charge the photoreceptor drum 101*a* surface uniformly while inhibiting generation of ozone gas as far as possible.

Thereafter, the electrostatic latent image on photoreceptor drum 101*a* is developed by developing unit 102*a* into a toner image. The thus visualized toner image is transferred onto intermediate transfer belt 11 by means of primary transfer unit 13*a* which is applied with a bias voltage of a polarity opposite to that of the toner. The other three visual image forming units pb, pc and pd also operate in the same manner, and the toner images are successively transferred onto intermediate transfer belt 11.

The toner image on intermediate transfer belt 11 is conveyed to secondary transfer unit 14 and transferred to a recording sheet (image recording medium) that is fed by a paper feed roller 16*a* of interior paper feed unit 16 or by a paper feed roller 17*a* of manual paper feed unit 17, under the application of a bias voltage of a polarity opposite to that of the toner. The toner image on the recording sheet (image recording medium) is conveyed to fixing and reusing unit 15. When the recording sheet (image recording medium) is plain paper, the toner image is heated and fused onto the recording sheet (image recording medium) by means of a fixing and removing roller 42 (FIGS. 3, 6 and 7) that is heated by laser irradiation, and then discharged out of the apparatus. When the recording sheet (image recording medium) is a special sheet, the surface of the recording sheet is directly irradiated and heated with the laser so that the toner image is fused and fixed on the recording sheet (image recording medium) and then is discharged out of the apparatus (details will be described later).

Next, the image erasing process for the special sheet will be described hereinbelow.

When image erasure is performed, in a state where visual image forming units pa, pb, pc and pd remains unoperated, a special sheet with an image formed thereon is fed by paper feed roller 16*a* of interior paper feed unit 16 or by paper feed roller 17*a* of manual paper feed unit 17 and conveyed up to secondary transfer unit 14. In secondary transfer unit 14, the recording paper is just conveyed into fixing and reusing unit 15 without any application of bias voltage. The toner on the recording paper is removed by fixing and reusing unit 15 and then discharged out of the apparatus (details will be described later).

Next, the special sheet of the present invention will be described in detail with reference to FIG. 2.

Figure 2A:
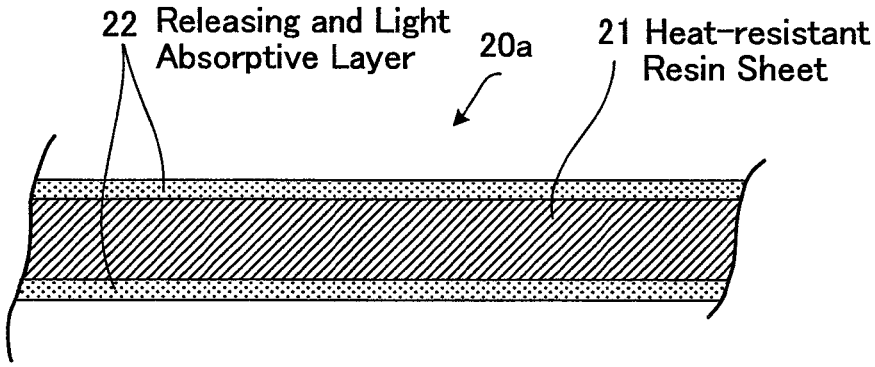
FIG. 2 is an illustrative diagram of a special sheet that can be repeatedly used.

The special sheet of the present invention has a three-layered structure 20*a* formed of a heat-resistant resin sheet 21 having a releasing and light absorptive layer 22 formed on either side, as shown in FIG. 2A.

Releasing and light absorptive layer 22 functions to absorb laser light and generates heat so as to fuse the toner image and fix it onto the special sheet surface at the time of image forming and to assure appropriate releasing performance to readily allow the re-fused toner image to be removed at the time of image removal. Accordingly, releasing and light absorptive layer 22 is formed of a fluororesin such as PFA, PTFE or the like, internally added with one to five parts by weight of an infrared absorbent such as phthalocyanine, polymethine, cyanine, nickel complex or the like so as to be 10 to 30 (μm) thick.

Since heat-resistant resin sheet 21 needs to be proof against the temperature of releasing and light absorptive layer 22 heated by laser light (130 to 200 (° C.)), allylester curing resin having a heat-resistant temperature of 250 (° C.), for example can be used. The layer thickness is set at 80 to 100 (μm).

Figure 2B:
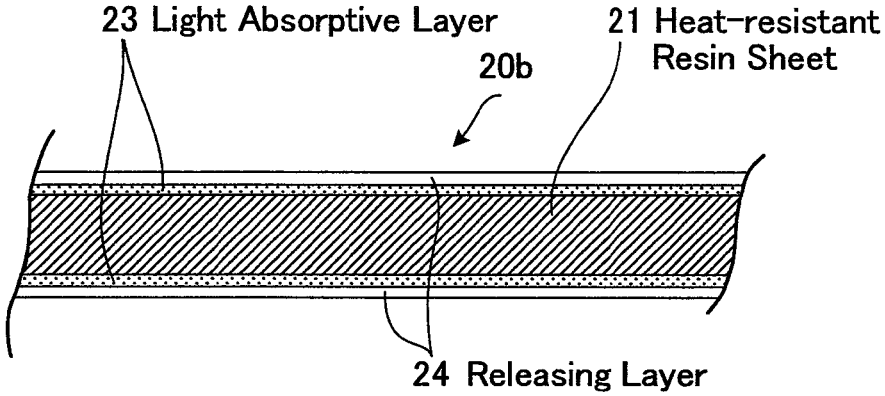

Another configuration of the special sheet may have a five-layered structure 20*b* in which a light absorptive layer 23 and a releasing layer 24 are individually provided as shown in FIG. 2B. This configuration splits the functions of light absorptive layer 23 and releasing layer 24 from each other, so that it is possible to specialize light absorptive layer 23 for light absorption (heat generation) purposes and releasing layer 24 for releasing purposes, hence maximize the individual effects. In this case, since releasing layer 24 needs to permit laser light to pass therethrough, the releasing layer needs to be formed of a transparent material. As a material that is transparent and excellent in releasing performance, fluororesin such as PFA, PTFE or the like, is suitable, and the layer thickness is set at 10 to 30 (μm). Light absorptive layer 23 is formed of a heat-resistant resin such as allylester curing resin or the like, internally added with one to five parts by weight of an infrared absorbent such as phthalocyanine, polymethine, cyanine, nickel complex or the like so as to have a layer thickness of 10 to 30 (μm).

Figure 2C:
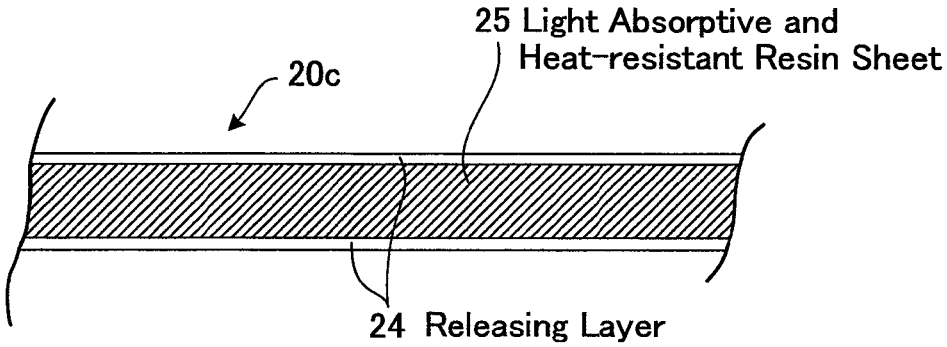

Further, as another structure 20*c* shown in FIG. 2C, a heat-resistant resin sheet may be internally added with an infrared absorbent so that the heat-resistant resin sheet also serves as a light absorptive layer (light absorptive and heat-resistant resin sheet 25). This enables simplification of the special sheet composition, hence a low-cost configuration due to reduction of the steps of manufacturing can be realized.

Next, the configuration of the fixing and reusing unit of the present invention will be described in detail with reference to FIGS. 3 to 7.

Figure 3:
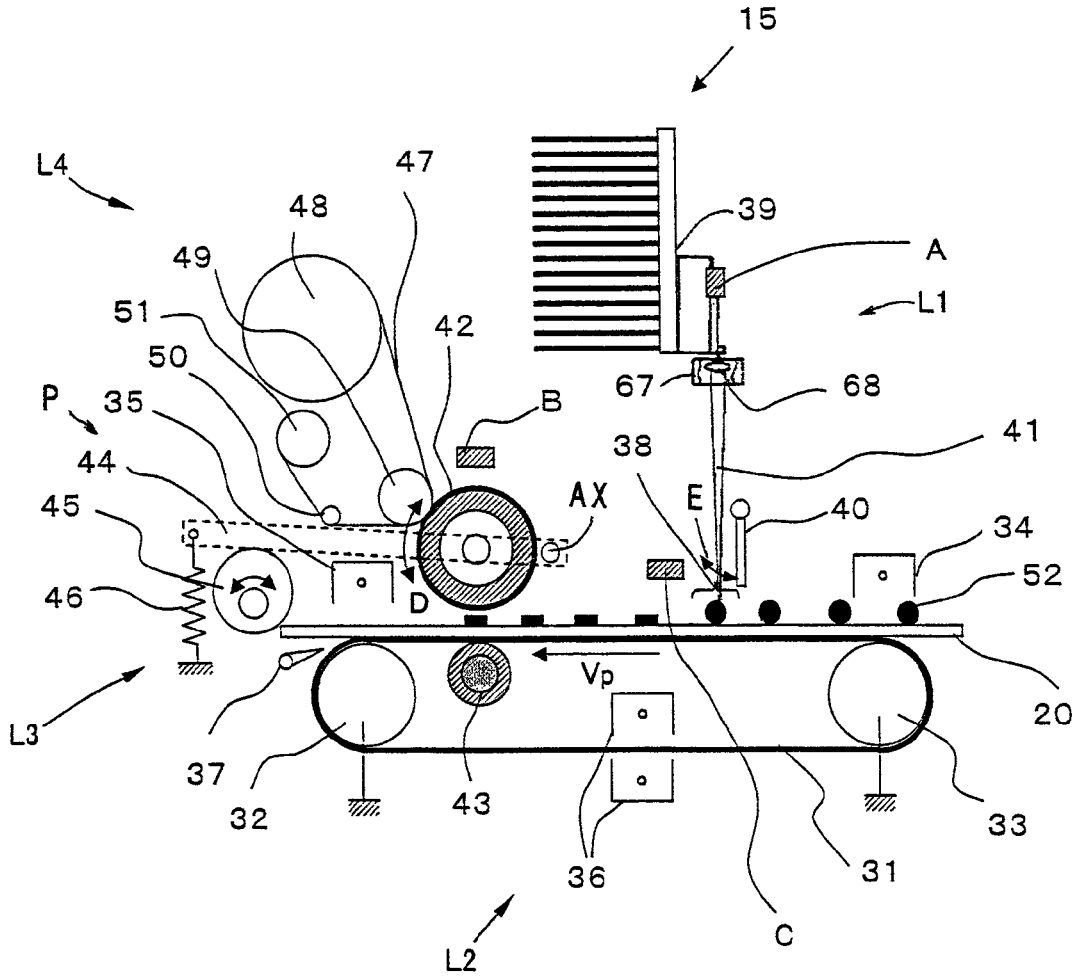
FIG. 3 is a configurational illustrative diagram showing a state of a fixing and reusing unit when the device is engaged in forming an image (fixing a toner image) on a special sheet.

As shown in FIG. 3, fixing and reusing unit 15, including a laser head (laser emitter) L1, a sheet conveying device (sheet conveyor) L2, a fixing and toner removing device L3 and a cleaning and releasing agent applying device L4, fixes the toner image formed on the surface of the image recording medium, or removes the toner image from the image recording medium, with heat from the laser.

The unfixed toner image is formed of a toner, which is included in the developer such as, for example, a non-magnetic mono-component developer including a non-magnetic toner, a non-magnetic dual component developer including a non-magnetic toner and a carrier, and a magnetic developer including a magnetic toner.

Sheet conveying device L2 includes a conveyor belt 31, a drive roller 32, a driven roller 33, an attraction charger 34, a separation charger 35, an erasing charger 36, a separation claw 37, a drive motor (not shown) and a temperature sensor C.

Conveyor belt 31 has a belt thickness of 75 (μm) thick and is formed of polyimide resin having a volume resistivity of $10^{16}$ (Ω·cm), being tensioned between drive roller 32 and driven roller 33.

Drive roller 32 is rotationally driven at an arbitrary speed by a drive motor (not shown), so that conveyor belt 31 is circulated by rotation of drive roller 32 at an arbitrary velocity Vp in the direction of the arrow. Arranged round conveyor belt 31 are attraction charger 34, a separation charger 35, erasing charger 36 and separation claw 37.

In this arrangement, the sheet (image recording medium) 20 with an unfixed toner image formed thereon, being conveyed from secondary transfer unit 14 (FIG. 1), is fed to and between conveyor belt 31 on driven roller 33 and attraction charger 34. Driven roller 33 is formed of a conductive material and grounded. Accordingly, when electric charge is given to the sheet (image recording medium) from attraction charger 34, dielectric polarization is caused in each of the sheet (image recording medium) and conveyor belt 31. As a result, the sheet (image recording medium) 20 is electrostatically attracted to conveyor belt 31. Sheet (image recording medium) 20 is conveyed by the drive of drive roller 32 toward a laser exposure station 38. The unfixed toner image on the sheet (image recording medium) that reaches laser exposure station 38 is irradiated with laser light by means of laser head L1 in accordance with the image information and fixed to the sheet.

The sheet (image recording medium) with the toner image fixed through laser exposure station 38, as being statically attracted to conveyor belt 31, is conveyed to and between separation charger 35 and drive roller 32.

Drive roller 32 is formed of a conductive material and grounded. Accordingly, when separation charger 35 erases electricity on the sheet (image recording medium), the electrostatic attraction between conveyor belt 31 and the sheet (image recording medium) weakens. Since, conveyor belt 31 travels along drive roller 32 with a large curvature, the leading end of the sheet (image recording medium) under this condition comes off conveyor belt 31 and the sheet (image recording medium) is completely separated by separation claw 37 from conveyor belt 31. The conveyor belt 31 after the sheet (image recording medium) has been peeled off is cleared of electricity on both the exterior and interior sides by erasing charger 36, then is driven to the position for attracting sheet (image recording medium).

Further, a temperature sensor C made of anon-contact thermistor for detecting the temperature of the conveyor belt 31 surface is arranged along the belt surface downstream of laser exposure station 38. This temperature sensor C is positioned at the center with respect to the longitudinal direction of fixing and reusing unit 15. Based on the temperature data detected by this temperature sensor C, the controller controls the laser power of laser head L1 or the conveying speed of conveyor belt 31.

Laser head L1 functions to irradiate the unfixed toner image at laser exposure station 38 with laser light to fix the toner to the sheet (image recording medium) at the time of image forming and irradiate toner removing roller 42 with laser light to heat the toner removing roller surface at the time of image erasing.

Figure 4:
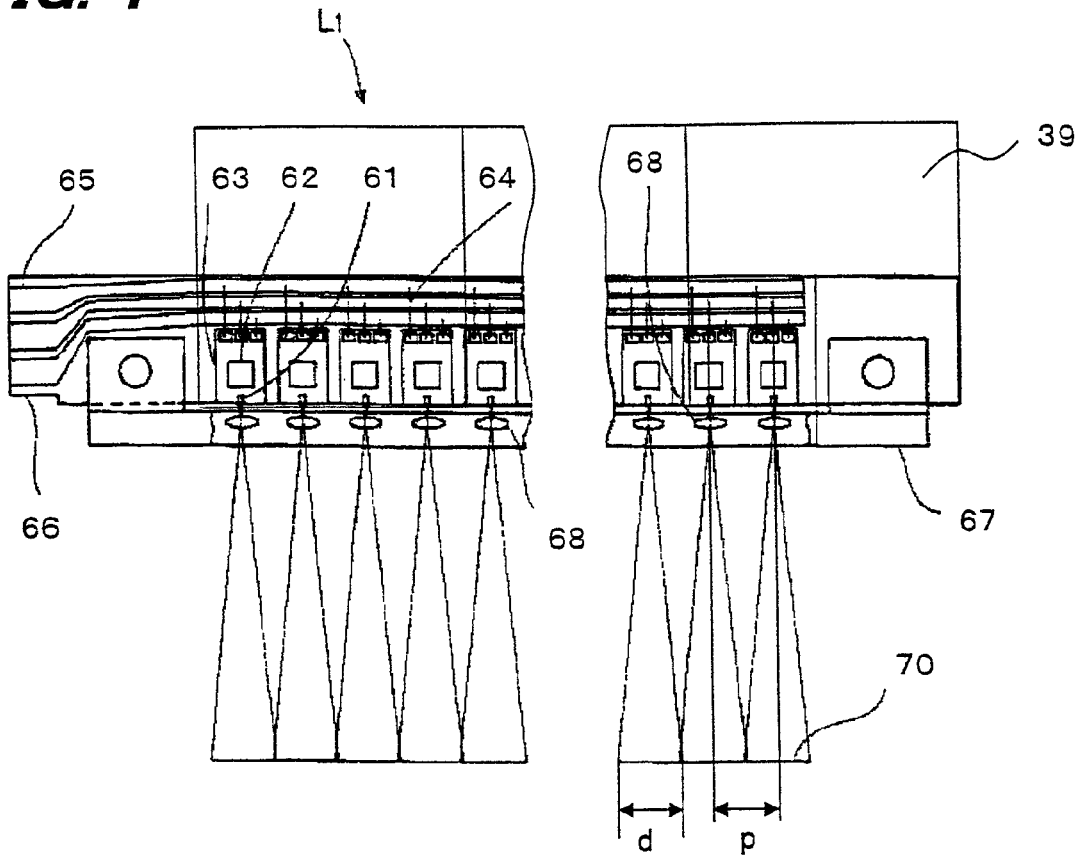
FIG. 4 is a configurational illustrative diagram of a laser head of a fixing and reusing unit when viewed from the front.
Figure 5:
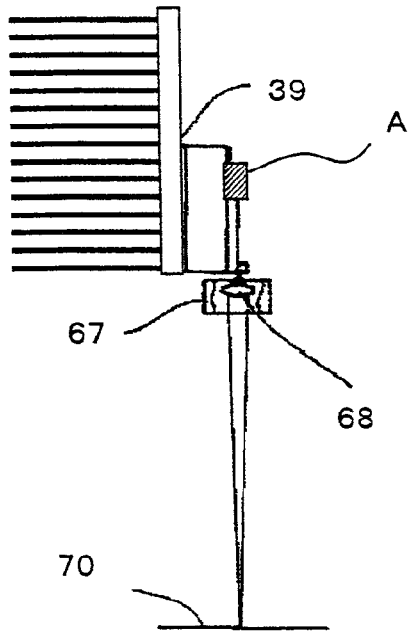
FIG. 5 is a configurational illustrative diagram of a laser head of a fixing and reusing unit when viewed from the side.

As shown in FIGS. 3, 4 and 5, laser head L1 includes: a semiconductor laser array formed of a plurality of semiconductor laser chips 61 being arrayed in a row in the width direction (in the direction perpendicular to the travel direction) of conveyor belt 31; a radiator plate (heat sink) 39; a temperature sensor A; and a reflecting mirror 40. In the present embodiment, the semiconductor laser array is composed of 1,000 laser chips 61, each having a rated output power of 150 (mW) and a wavelength of 780 (nm), being arrayed. In this array, the laser chips are arranged with a pitch p of 0.3 (mm) and the laser spot d is also specified to be 0.3 (mm) in diameter. As heat sink 39, ten UB30-27 heat sinks (a product of Alpha Company Ltd.) formed of aluminum alloy having a base size of 30 (mm)×30 (mm) and a height of 20 (mm) with a heat resistance of 1.6 (° C./W) (total heat resistance 0.16 (° C./W)), arranged in a row are used.

Next, the detailed configuration of laser head L1 will be described with reference to FIG. 4.

A silicon substrate 63 has a control circuit (not shown) and a monitoring photodiode 62 as a photo receiver, monolithically formed thereon. The control circuit varies the laser light power based on the input signal and keeps the laser power constant based on the signal from monitoring photodiode 62. Semiconductor laser chip 61 is mounted on this silicon substrate 63. The laser chip 61 and silicon substrate 63 are electrically connected by bonded wires 64.

Subsequently, a plurality of laser chip-equipped silicon substrates 63 are attached on a ceramic board 66, and surface electrodes 65 of ceramic board 66 and the electrodes on silicon substrates 63 are electrically connected by bonded wires.

Finally, heat sink 39 and a lens holder 67 holding a plurality of condensing optical systems, i.e., a plurality of convex lenses 68, are attached to this ceramic board 66 with multiple laser devices equipped thereon. Thus, laser head L1 according to the present embodiment is manufactured.

As to the configuration for multiple convex lenses 68 and their lens holder 67 in this laser emitter, lens arrays such as a resin molding that constitutes lenses and a lens holder in an integrated manner or a planner micro lens array that is manufactured by shaping a flat glass plate into a lenticular structure by ion exchange, are more advantageous in view of price, process and assembly precision, compared to the configuration in which individual convex lenses 68 are assembled in a resin holder etc. Alternatively, the laser beams may be radiated on the toner image as they remain in parallel light without using any condensing optical system.

Further, a temperature sensor A (FIGS. 3 and 5) made of a thermistor for monitoring the temperature of laser head L1 is attached on ceramic board 66. This temperature sensor A is disposed at the center with respect to the aforementioned width direction of conveyor belt 31. In this arrangement, when temperature data detected by temperature sensor A approaches the heat resistant temperature (50 (° C.)) of semiconductor laser chips 61 (FIG. 4), the image forming operation or the image erasing operation is suspended.

Arranged between laser head L1 and conveyor belt 31 is reflecting mirror 40 (FIG. 3), which can be moved about a pivot by a drive mechanism (not shown) in the direction of arrow E. This reflecting mirror 40 is shifted by the drive mechanism to the position where it reflects laser light 41 towards the fixing and removing roller 42 a shown in FIGS. 6 and 7 when image erasure for special sheet is performed and when image forming is performed for plain paper.

Fixing and toner removing device L3 includes fixing and removing roller 42, a backup roller 43, an automatic pressure relieving mechanism P and a temperature sensor B for measuring the surface temperature of fixing and removing roller 42.

Figure 6:
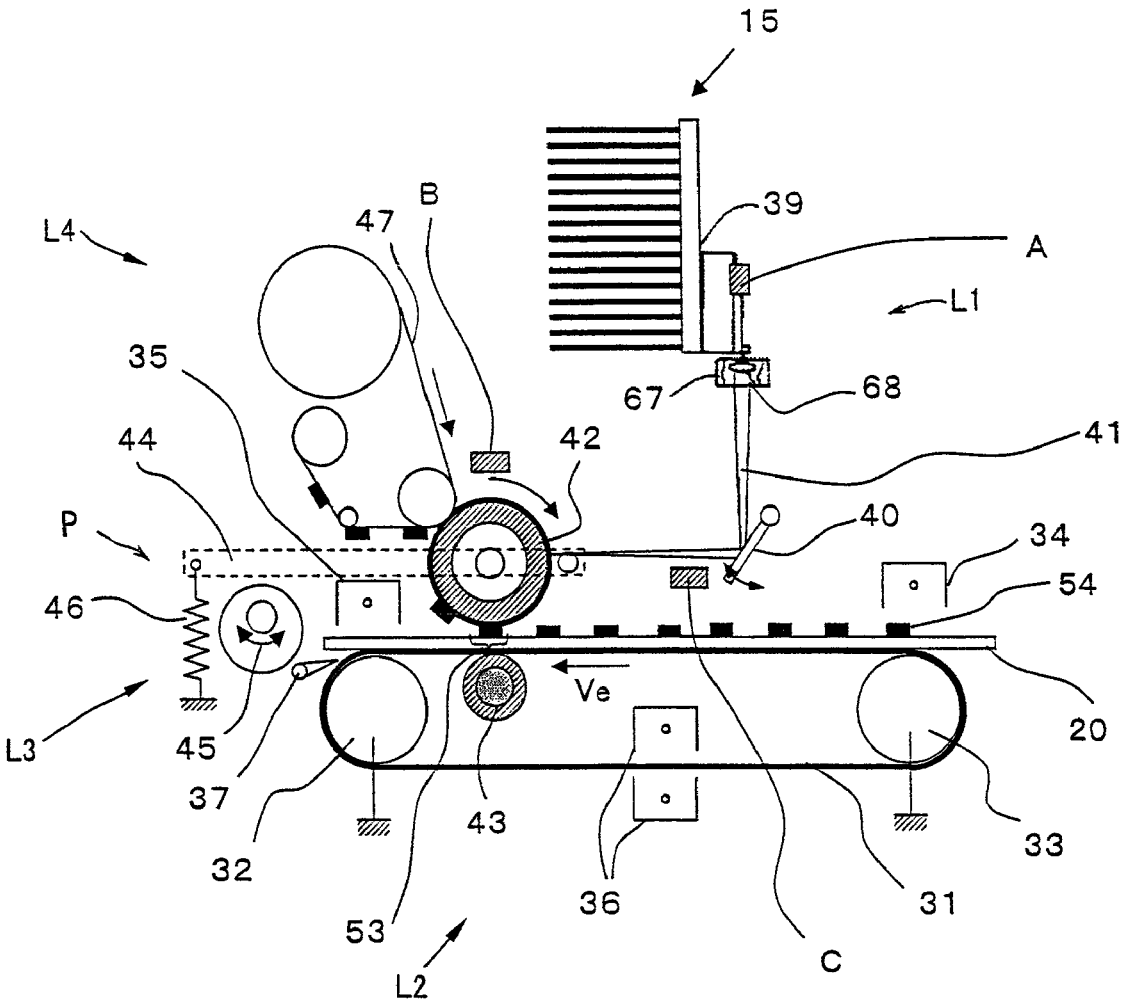
FIG. 6 is a configurational illustrative diagram showing a state of a fixing and reusing unit being engaged in erasing the image (removing the toner image) on a special sheet.

When the pressure between fixing and removing roller 42 and backup roller 43 is not relieved by automatic pressure relieving mechanism P, these rollers are pressed against each other with a predetermined load (e.g., 360 (N) in this embodiment) forming a nip portion 53 (the area where fixing and removing roller 42 and backup roller 43 abut each other) shown in FIG. 6 between these two rollers. In the present embodiment, the width of nip portion 53 (the dimension of the nip portion in the recording paper's direction of conveyance) is specified to be 4 (mm).

When image erasure for special sheet 20 is performed, the toner image is removed from special sheet 20 by feeding and passing the special sheet 20 with a fixed toner image formed, through this nip portion 53.

When image forming is performed for plain paper 27 (FIG. 7), the toner image is fixed to plain paper 27 by feeding and passing the plain paper 27 with an unfixed toner image formed, through this nip portion 53.

Fixing and removing roller 42 is heated to a predetermined temperature by laser irradiation so as to remove the toner image from the special sheet 20 with a toner image fixed or fix the toner image on plain paper 27 with an unfixed toner image formed thereon as the sheet is conveyed through the nip portion 53.

Fixing and removing roller 42 is 32 (mm) in diameter, having a three-layered structure formed of a metal core, an elastic layer and a light absorptive layer in the order from the interior. The metal core may employ metal such as iron, stainless steel, aluminum, copper, etc. or alloys of these, and the like. As the elastic layer, an elastic material having heat resistance such as silicone rubber etc. may be used. As the light absorptive layer, materials having heat resistance and light absorbing performance, such as polyimide, fluororubber and the like are preferably used. In this embodiment, the roller is formed of a stainless steel metal core of 28 (mm) in diameter and having a wall thickness of 1 (mm), an elastic layer of silicone rubber of 2 (mm) thick and a light absorptive layer of fluororubber of 30 (μm) thick coated on the silicone rubber surface.

Backup roller 43 is 20 (mm) in diameter, having a two-layered structure formed of a metal core and an elastic layer in the order from the interior. The metal core may employ metal such as iron, stainless steel, aluminum, copper, etc. or alloys of these, and the like. As the elastic layer, an elastic material having heat resistance, such as silicone rubber etc. may be used. In this embodiment, the roller is formed of a stainless steel metal core of 14 (mm) in diameter and an elastic layer of silicone rubber of 3 (mm) thick.

In this configuration, automatic pressure relieving mechanism P for automatically applying a load on backup roller 43 is provided for fixing and removing roller 42. This automatic pressure relieving mechanism P includes, in the present embodiment, a pivot axis AX, a pressing arm 44, an eccentric cam 45 and a pressing spring 46, as shown in FIG. 3.

Pivot axis AX and cam 45 are arranged so as to hold fixing and removing roller 42 therebetween. Pivot axis AX and the axis of cam 45 are arranged at fixed positions relative to conveyor belt 31.

Pressing arm 44 is rotatably supported at one end by pivot axis AX while the other end is coupled with pressing spring 46 so that the arm is constantly urged against cam 45 by the repulsive force of pressing spring 46. Also, pressing arm 44 supports fixing and removing roller 42 so that it can turn freely.

Accordingly, as cam 45 rotates, pressing arm 44 rotationally moves up and down about pivot axis AX, so that fixing and removing roller 42 is able to move in the direction of arrow D with the swaying movement of pressing arm 44. Thus, fixing and removing roller 42 is provided so as to move close to, and away from, conveyor belt 31.

Cleaning and releasing agent applying device L4 includes: a cleaning web 47, which cleans the toner collected by fixing and removing roller 42, from fixing and removing roller 42 when image removal for special sheets is performed, and applies a releasing agent on fixing and removing roller 42 when image forming for plain paper is performed; a supply roller 48, a pressing roller 49, a tension roller 50 and a take-up roller 51.

Supply roller 48 is configured so that an unused cleaning web 47 is wound thereon. Take-up roller 51 is configured so as to take up the cleaning web 47 delivered out from supply roller 48. In this embodiment, take-up roller 51 is configured so as to take up 0.5 (mm) of cleaning web 47 per sheet when image forming for plain paper 27 is performed, and take up 1 (mm) of cleaning web 47 per sheet when image erasing for special sheet 20 is performed.

Pressing roller 49 is configured so as to press cleaning web 47 onto fixing and removing roller 42.

Tension roller 50 is configured so as to apply tension to cleaning web 47.

Cleaning web 47 is a water-jet entangled nonwoven fabric of 40 (μm) thick which is made of polyamideimide fabric and polyester fabric entangled in a weight ratio of 50:50 (wt %), and impregnated with 6 ($g/m^2$) of amino-modified silicone oil having a viscosity of 10,000 (cs) as a releasing agent.

Further, arranged on the peripheral surface of fixing and removing roller 42 is temperature sensor B made of a non-contact thermistor for detecting the temperature of the peripheral surface. This temperature sensor B is disposed at the center with respect to the length of fixing and removing roller 42. Based on the temperature data detected by temperature sensor B, the controller controls the laser power of laser head L1 or conveying speed Vp of conveying device L2.

Next, the fixing operation for special sheet 20 by fixing and reusing unit 15 will be specifically described with reference to FIG. 3. The fixing operation of the fixing and reusing unit for the special sheet includes six steps as follows.

(Step a1) The application of pressure of fixing and removing roller 42 to backup roller 43 is relieved by automatic pressure relieving mechanism P so that fixing and removing roller 42 is separated from conveyor belt 31.

(Step a2) Reflecting mirror 40 is moved and set to the position where the mirror will not shade (or reflect) laser light 41.

(Step a3) Special sheet 20 bearing an unfixed toner image thereon is conveyed by sheet conveying device L2 to laser exposure station 38 on conveyor belt 31, at the fixing speed (sheet conveying speed) and copying speed that are determined based on the document printed ratio.

(Step a4) Laser light 41 is emitted from laser head L1 in time with arrival of the toner image to laser exposure station 38.

(Step a5) Laser light 41 is absorbed by the light absorptive layer of special sheet 20 and converted into heat so as to fuse the unfixed toner image and fix it to the image recording medium.

(Step a6) When it is necessary to enhance glossiness of the image after fixing, fixing and removing roller 42 is pressed against backup roller 43 beforehand. With this arrangement, the smoothness of the surface of fixing and removing roller 42 is transferred to the toner image surface after fixing, so that it is possible to improve glossiness of the image after fixing.

Next, the image erasing operation for the special sheet by the fixing and reusing unit will be specifically described with reference to FIG. 6. The image erasing operation of the fixing and reusing unit for the special sheet includes six steps as follows.

(Step b1) Fixing and removing roller 42 is pressed by automatic pressure relieving mechanism P against backup roller 43 with conveyor belt 31 therebetween, forming nip portion 53.

(Step b2) Reflecting mirror 40 is moved and set to the position where the mirror reflects laser light 41 toward fixing and removing roller 42.

(Step b3) Special sheet 20 bearing a fixed toner image 54 thereon is conveyed by sheet conveying device L2 to nip portion 53 on conveyor belt 31, at the predetermined fixing speed (sheet conveying speed) and copying speed.

(Step b4) Laser light 41 of a predetermined power is emitted from laser head L1 and reflected by reflecting mirror 40 so as to irradiate the surface of fixing and removing roller 42. The radiation is absorbed by the light absorptive layer on the fixing and removing roller 42 surface and converted into heat so as to increase the fixing and removing roller 42 surface in temperature.

(Step b5) The fixed toner image on special sheet 20 is re-fused in nip portion 53 by fixing and removing roller 42. The re-fused toner 54 sticks to and is collected by fixing and removing roller 42 because the surface (fluororubber) of fixing and removing roller 42 is low in releasability compared to the surface (fluororesin) of special sheet 20.

(Step b6) The toner collected by fixing and removing roller 42 is cleaned from fixing and removing roller 42 by means of cleaning web 47 that is abutted at a position on the downstream side against the roller as its being taken up at a predetermined speed.

Figure 7:
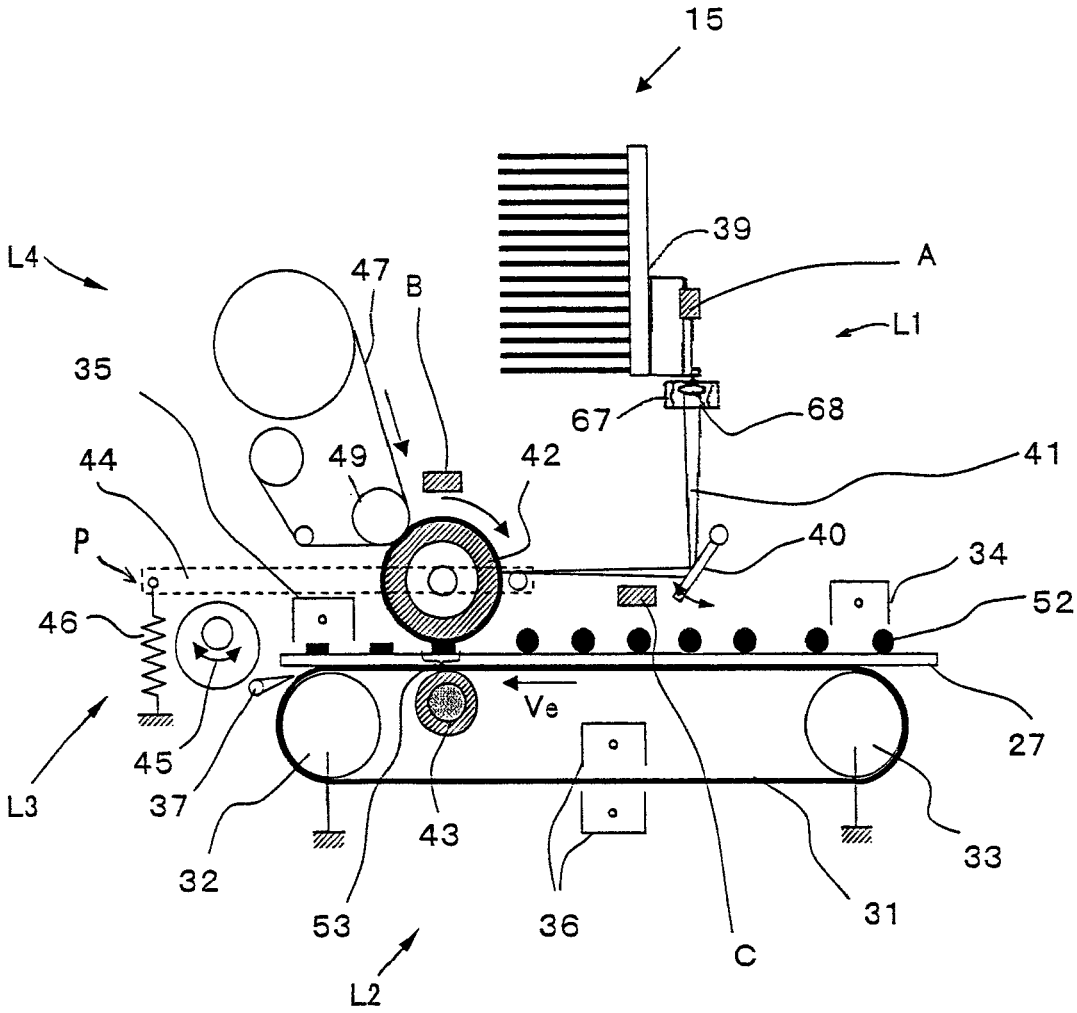
FIG. 7 is a configurational illustrative diagram showing a state of fixing and reusing unit being engaged in fixing the image (fixing the toner image) to a conventional plain paper that is not reusable.

Next, the image forming operation for plain paper by the fixing and reusing unit of the present invention will be specifically described with reference to FIG. 7. The image forming operation of the fixing and reusing unit of the present invention for plain paper includes six steps as follows.

(Step c1) Fixing and removing roller 42 is pressed by automatic pressure relieving mechanism P against backup roller 43 with conveyor belt 31 therebetween, forming nip portion 53.

(Step c2) Reflecting mirror 40 is moved and set to the position where the mirror reflects laser light 41 toward fixing and removing roller 42.

(Step c3) Plain paper 27 bearing an unfixed toner image 52 thereon is conveyed by sheet conveying device L2 to nip portion 53 on conveyor belt 31, at the predetermined fixing speed (sheet conveying speed) and copying speed.

(Step c4) Laser light 41 of a predetermined power is emitted from laser head L1 and reflected by reflecting mirror 40 so as to irradiate the surface of fixing and removing roller 42. The radiation is absorbed by the light absorptive layer on the fixing and removing roller 42 surface and converted into heat so as to increase the fixing and removing roller 42 surface in temperature.

(Step c5) A releasing agent (amino-modified silicone oil) is applied on the fixing and removing roller 42 surface by means of cleaning web 47 that is pressed by pressing roller 49 and being taken up at a predetermined speed. Since amino-modified silicon oil has an excellent affinity for the fluororubber (light absorptive layer) on the surface of fixing and removing roller 42, the oil can be applied uniformly in a predetermined amount over fixing and removing roller 42.

(Step c6) The unfixed toner image on plain paper 27 is fused from heat and pressure in nip portion 53 by fixing and removing roller 42 and fixed to plain paper 27. In this step, since amino-modified silicone oil serving as a releasing agent has been uniformly applied on the surface of fixing and removing roller 42 and since the surface (fluororubber) of fixing and removing roller 42 is high in releasability compared to plain paper 27, almost all the toner, without being set off to fixing and removing roller 42, is fixed on plain paper 27. Besides, if a trace amount of toner to such an extent that the toner is invisible is set off (minute setoff) to fixing and removing roller 42, the toner is cleaned by the cleaning roller, never causing problems.

Next, the method of controlling the conveying speed and the laser output in the fixing and reusing unit of the present invention will be described hereinbelow with reference to FIGS. 8 and 9. Here, FIG. 8 is a block diagram showing a control system of fixing and reusing unit 15 and FIG. 9 is a flow chart showing the control sequence of fixing and reusing unit 15.

Figure 8:
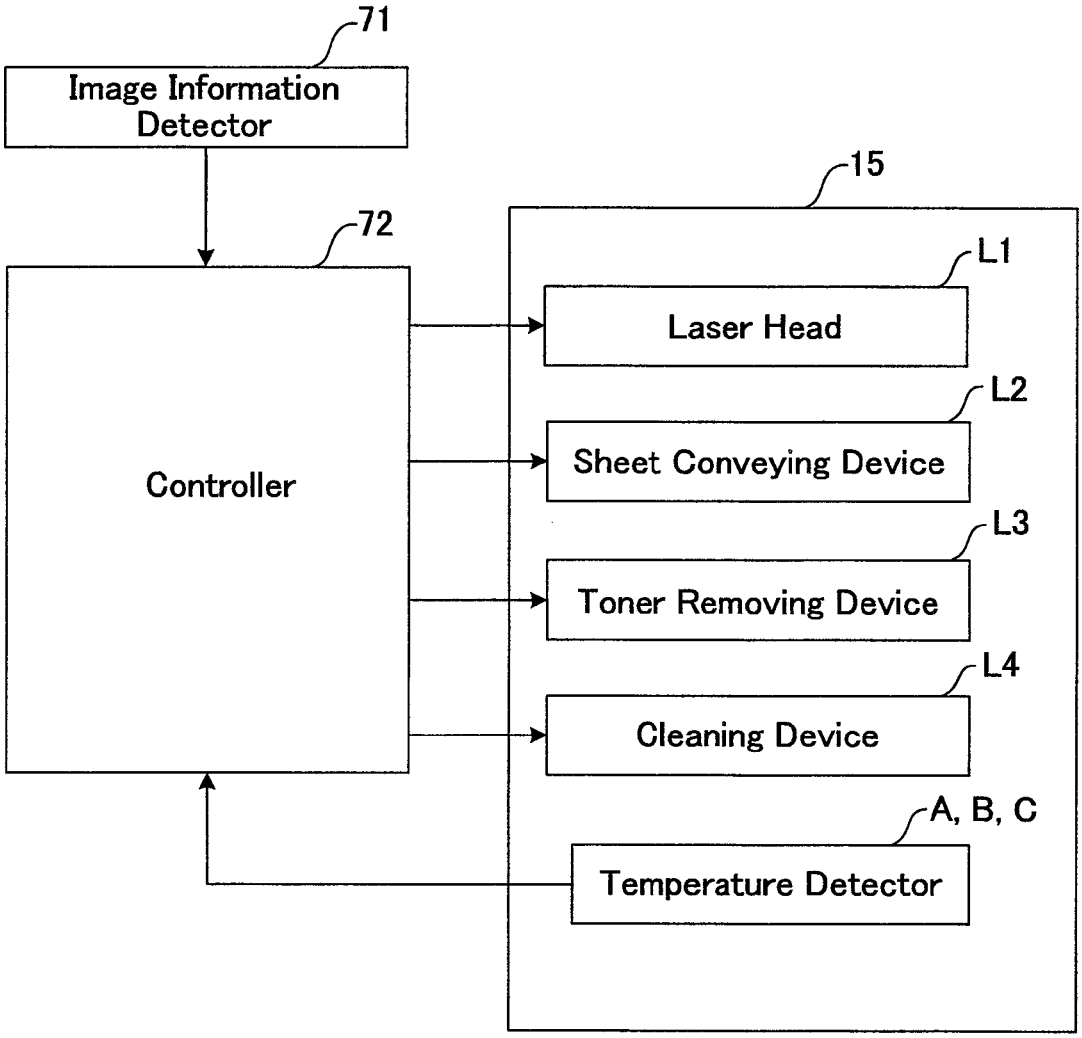
FIG. 8 is a block diagram showing a control system of a fixing and reusing unit; and, FIG. 9 is a flow chart showing the control sequence of a fixing and reusing unit.

As shown in FIG. 8, this control system includes an image information detector 71 for detecting input image information, fixing and reusing unit 15 shown in FIG. 3 and a controller 72 for controlling these.

Fixing and reusing unit 15 includes laser head L1, sheet conveying device L2, toner removing device L3, cleaning device L4, temperature detector (temperature sensors A, B and C).

Figure 9:
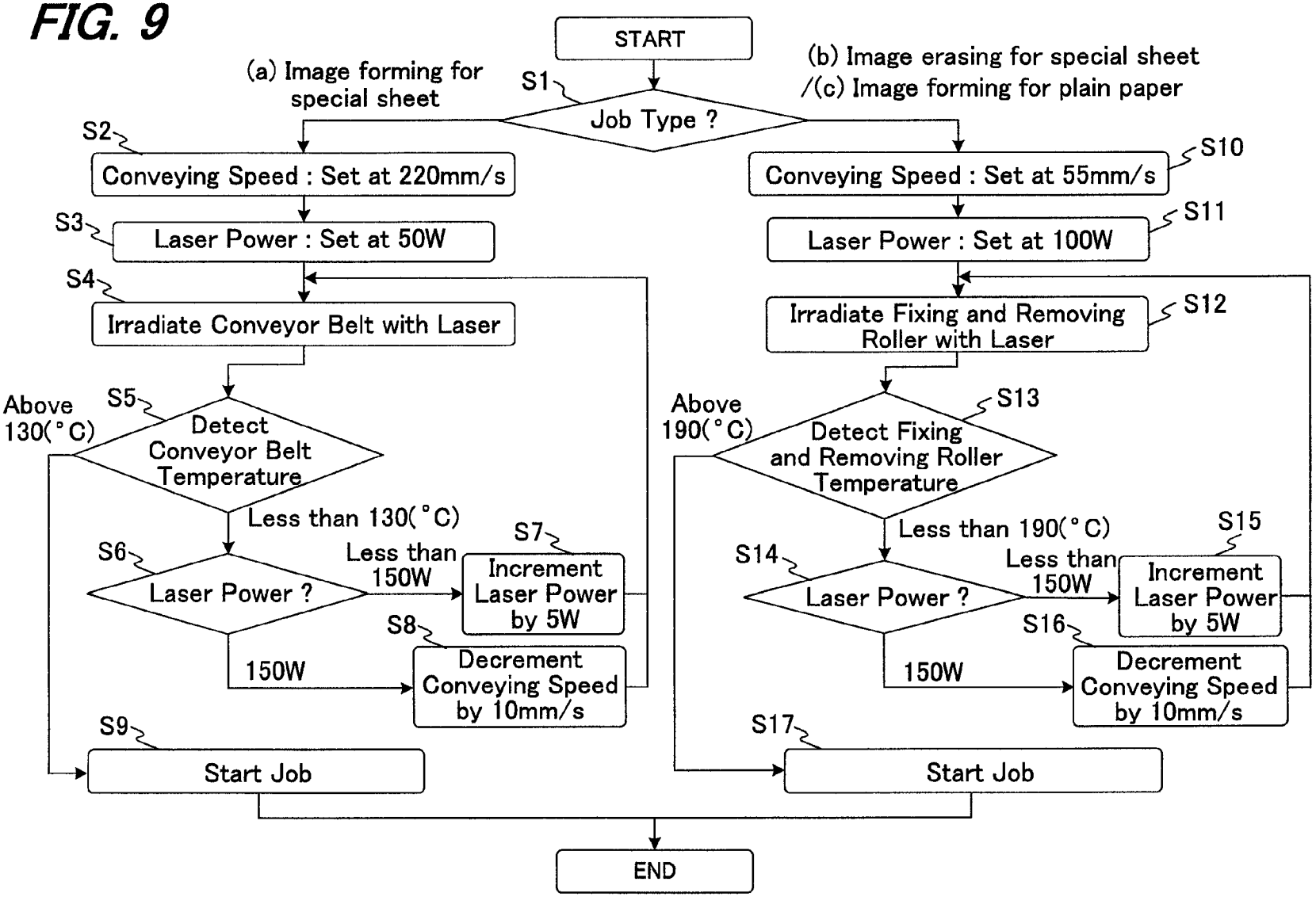

As shown in FIG. 9, initially, controller 72 determines the type of the job that is going to be done, (a) image forming for special sheet, (b) image removal for special sheet or (c) image forming for plain paper, based on the image information detected by image information detector 71 (Step S1).

If the job is of (a) image forming for special sheet, controller 72 sets the conveying speed of conveyor device L2 at 220 (mm/s) and the laser power at 50 (W) (Steps S2 and S3).

Then, the laser is radiated on conveyor belt 31 to heat the belt (Step S4). Then, the surface temperature of conveyor belt 31 is measured by temperature sensor C, and controller 72 determines whether the temperature is equal to or higher than 130 (° C.) or lower than 130 (° C.) (Step S5). If the temperature is determined to be 130 (° C.) or higher, it is equal to or higher than the melting point of the toner (130 (° C.) in this case), so that the control goes into image forming (Step S9) because the toner can be adequately fixed. On the other hand, if the temperature is less than 130 (° C.), controller 72 determines whether the laser power is less than 150 (W) or has reached 150 (W) (Step S6). If the laser power is less than 150 (W), the laser power is incremented by 5 (W) (Step S7) and the control returns to Step S4. If the condition of 130 (° C.) or higher cannot be cleared even after the laser power has reached 150 (W), the conveying speed is decremented by 10 (mm/sec) (Step S8) because the maximum rated power of the laser is 150 (W), and the control returns to Step S4. Then, when the surface temperature of conveying belt 31 has reached 130 (° C.) or greater, the control goes into image forming (Step S9). At the time of image forming, based on the image information detected by image information detector 71, laser light is selectively radiated on the areas where the image exists. With this manipulation, it is possible to reduce self-heating of laser head L1 to the bare minimum, hence improve heat efficiency.

On the other hand, when the job is of (b) image erasing for special sheet or of (c) image forming for plain paper, controller 72 sets the conveying speed of conveyor device L2 at 55 (mm/s), which is lower than the speed for the above-described image forming, and the laser power at 100 (W), which is higher than the above image forming (Steps S10 and S11). In the cases of (b) image erasing for special sheet and (c) image forming for plain paper, the laser light is used in an indirect manner (the laser light is reflected by reflecting mirror 40 first, then absorbed by fixing and removing roller 42 to generate heat), in contrast to the case of (a) image forming for special sheet where laser light is directly radiated on the toner image, hence the laser efficiency becomes lower than that for the image forming for special sheet. This is why the aforementioned setup is adopted. For this reason, the necessary amount of energy is secured by retarding the sheet conveying speed or by increasing the laser power in the cases of (b) image erasing for special sheet and (c) image forming for plain paper.

After setting the conveying speed and the laser power, the laser is radiated on fixing and removing roller 42 to heat it (Step S12). Then, the surface temperature of fixing and removing roller 42 is measured by temperature sensor B, and controller 72 determines whether the temperature is equal to or higher than 190 (° C.) or lower than 190 (° C.) (Step S13). If the temperature is determined to be 190 (° C.) or higher, it is surely possible to fuse the toner image and remove the toner from the recording medium, so the control directly goes into image erasing (Step S17). On the other hand, if the temperature is less than 190 (° C.), controller 72 determines whether the laser power is less than 150 (W) or has reached 150 (W) (Step S14). If the laser power is less than 150 (W), the laser power is incremented by 5 (W) (Step S15) and the control returns to Step S12. If the condition of 190 (° C.) or higher cannot be cleared even after the laser power has reached 150 (W), the conveying speed is decremented by 10 (mm/sec) (Step S16) because the maximum rated power of the laser is 150 (W), and the control returns to Step S12. Then, when the surface temperature has reached 190 (° C.) or greater, the control goes into image erasing (Step S17). Here, In the cases of (b) image erasing for special sheet and (c) image forming for plain paper, since it is difficult to heat just the areas where the image exists on the image recording medium, the laser light is irradiated on the whole surface, differing from the case of image forming for special sheet.

Additionally, when a new image is formed on the special sheet having an image formed thereon, the duplex printing function of the image forming apparatus may be used so that image erasure is performed for the first page, then image forming is performed for the second page. With this, it is possible to achieve image erasing and image forming at the same time by a single job (paper pass).

Though the present embodiment has been described taking an example where four colors of toners, yellow (Y), magenta (M), cyan (C) and black (B) are used, the present invention should not be limited to this configuration, and can be applied to a configuration using six colors of toners, additionally including light cyan (LC) and light magenta (LM).

What is claimed is:

1. An image recording medium that can be used repeatedly by erasing toner images, comprising a light absorptive layer that absorbs light to generate heat, provided in the vicinity of the surface thereof, wherein the light absorptive layer includes a fluororesin.

2. The image recording medium according to claim 1, further comprising a substrate formed of a heat-resistant resin.

3. The image recording medium according to claim 2, wherein the heat-resistant resin is an allylester curing resin.

4. The image recording medium according to claim 2, wherein the substrate also serves as a light absorptive layer.

5. An image recording medium that can be used repeatedly by erasing toner images, comprising a light absorptive layer that absorbs light to generate heat, provided in the vicinity of the surface thereof, wherein the surface of the light absorptive layer is additionally coated by a transparent releasing layer.

6. The image recording medium according to claim 5, wherein the releasing layer is formed of a fluororesin.

7. An image recording medium reusing apparatus, comprising:

a conveyor for conveying an image recording medium with a toner image formed thereon;

a laser emitter for emitting laser to the image recording medium;

a removing portion whose surface is heated by the laser emitter for removing the toner image from the image recording medium by thermally fusing the toner image by abutting the heated surface against the toner image surface of the image recording medium; and, a controller for controlling the conveyor, the laser emitter, and the removing portion, characterized in that the laser emitter also serves as a fixing heat source for fixing a toner image to an image recording medium, and a light absorptive layer that absorbs light to generate heat is provided in the vicinity of the surface of the image recording medium.

8. The image recording medium reusing apparatus according to claim 7, wherein the toner image is formed of a color toner.

9. The image recording medium reusing apparatus according to claim 7, further comprising:

an optical path changer for changing the optical path of the laser light emitted from the laser emitter, wherein the laser light is led to irradiate the removing portion by means of the optical path changer so that the removing portion generates heat, and a toner image on an image recording medium consisting of plain paper is fixed with heat and pressure from the removing portion by bringing the removing portion in abutment with the toner image surface of the image recording medium.

10. The image recording medium reusing apparatus according to claim 7, wherein the surface of the removing portion is formed of a fluororubber.

11. The image recording medium reusing apparatus according to claim 10, further comprising:

an applicator for applying an amino-modified silicone oil to the surface of the removing portion.

12. The image recording medium reusing apparatus according to claim 11, wherein the applicator also serves as a cleaning portion of the toner collected by the removing portion.

13. The image recording medium reusing apparatus according to claim 7, wherein the controller changes the conveying speed of the image recording medium between when a toner image is fixed in an image forming mode and when a toner image is removed in an image erasing mode.

14. The image recording medium reusing apparatus according to claim 13, wherein the controller sets the conveying speed of the image recording medium in the image erasing mode lower than the conveying speed in the image forming mode.

15. The image recording medium reusing apparatus according to claim 7, wherein the controller changes the output power of the laser emitter between when a toner image is fixed in an image forming mode and when a toner image is removed in an image erasing mode.

16. The image recording medium reusing apparatus according to claim 15, wherein the controller sets the output power of the laser emitter in the image erasing mode higher than the output power in the image forming mode.

17. The image recording medium reusing apparatus according to claim 7, wherein the controller controls the laser light so as to selectively irradiate in accordance with image information.

18. The image recording medium reusing apparatus according to claim 7, wherein the controller, based on the temperature information on the conveyor, controls the laser power or the sheet conveying speed.

19. The image recording medium reusing apparatus according to claim 7, wherein the controller, based on the temperature information on the removing portion, controls the laser power or the sheet conveying speed.

20. The image recording medium reusing apparatus according to claim 7, wherein the laser emitter comprises a laser array formed of a plurality of semiconductor laser chips being arrayed in the direction perpendicular to the conveying direction of image recording mediums.

21. An image forming apparatus for electrophotographically forming an image with toner, comprising:

an image bearer having an electrostatic latent image formed on the surface thereof;

a charging device for electrifying the surface of the image bearer;

a light exposure device for forming an electrostatic latent image on the image bearer surface;

a developing device for forming a toner image by supplying the electrostatic latent image with toner;

a transfer device for transferring the toner image to an image recording medium;

a fixing device for fixing the transferred toner image to the image recording medium; and, an image recording medium reusing apparatus according to claim 8.

22. The image forming apparatus according to claim 21, wherein, in image forming, part of the removing portion that is not receiving radiation of laser is abutted on the toner image surface of the image recording medium.

23. The image forming apparatus according to claim 21, further comprising a duplex printing function, wherein in the duplex printing mode, image erasure is performed for the first page of the image recording medium, then image forming is performed for the second page of the image recording medium.

24. A medium reusing method of a recording medium that has been formed with an unfixed or fixed toner image, comprising the steps of:

in an image forming mode in which an unfixed toner image is fixed to an image recording medium, fixing an unfixed toner image to the image recording medium by directly radiating laser light on the image recording medium so as to heat the surface of the image recording medium, thereby heat and fuse the unfixed toner image; and, in an erasing mode in which a fixed toner image is removed from an image recording medium, removing the toner image from the image recording medium by radiating laser light on a removing portion so as to heat the surface of the removing portion and bringing the heated surface of the removing portion into contact with the toner image fixed on the image recording medium to thereby heat and fuse the toner image.

* * * * *